United States Patent [19]

Tischer

[11] Patent Number: 4,745,332

[45] Date of Patent: May 17, 1988

[54] CONTROL PLATE FOR PICTURE-REPRODUCING DEVICES

[75] Inventor: Kurt-Manfred Tischer, Wendlinger, Fed. Rep. of Germany

[73] Assignee: Standard Elektrik Lorenz A. G., Stuttgart, Fed. Rep. of Germany

[21] Appl. No.: 25,225

[22] Filed: Mar. 12, 1987

[30] Foreign Application Priority Data

Mar. 25, 1986 [DE] Fed. Rep. of Germany ..... 3609967

[51] Int. Cl.[4] ..... H01J 29/50

[52] U.S. Cl. ..... 313/422; 313/495

[58] Field of Search ..... 313/422, 495, 497, 584, 313/585, 103 CM, 105 CM

[56] References Cited

U.S. PATENT DOCUMENTS 4,356,427 10/1982 Noguchi et al. ..... 313/422
4,649,314 3/1976 Eschard ..... 313/103 CM
4,651,049 3/1987 Saeki et al. ..... 313/422 X

*Primary Examiner*—David K. Moore
*Assistant Examiner*—Sandra L. O'Shea
*Attorney, Agent, or Firm*—Peter C. Van Der Sluys

[57] ABSTRACT

Control plates in flat picture-reproducing devices are located between the cathode and the screen and serve to control the electron flow. Control plates are formed of layers of metal conductors having overlying openings. The width of the openings decreases with depth from both surfaces of the conductors. The openings can be formed by pairs of juxtaposed recesses formed in the sides of adjacent conductors.

11 Claims, 2 Drawing Sheets

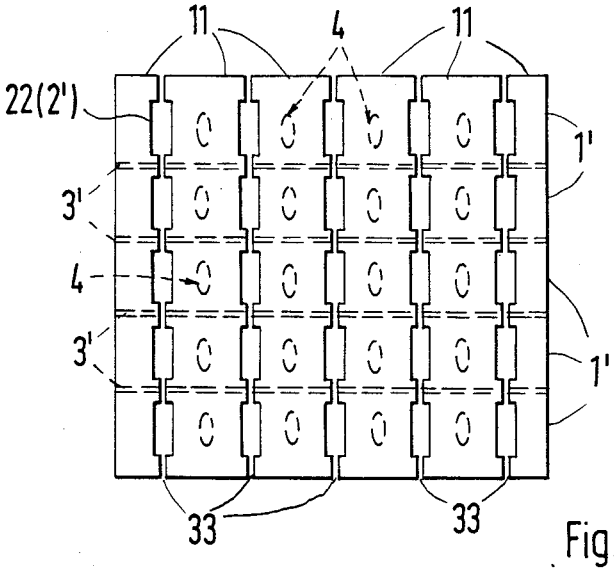
Fig. 4
Fig. 5
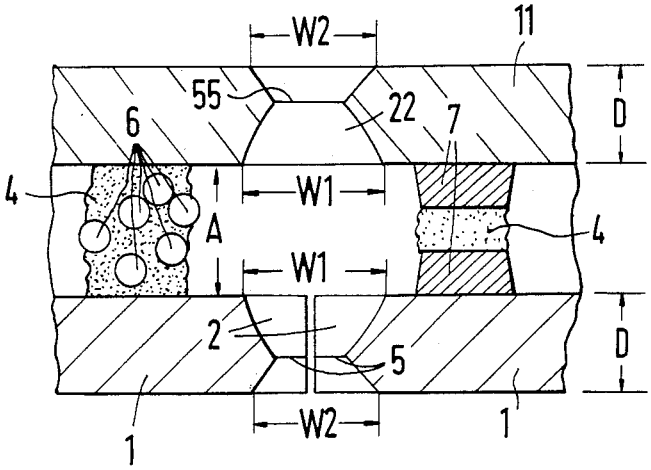

CONTROL PLATE FOR PICTURE-REPRODUCING DEVICES

BACKGROUND OF THE INVENTION

1. Field of the Invention

The present invention relates to a control plate for a picture-reproducing device and more particularly to a control plate for a flat picture reproducing device.

2. Description of the Prior Art

In an article by W. C. Holton et al, "Design, Fabrication, and Performance of a Flat Tube Display" (1977 International Electron Devices Meeting, pp. 78–80, Washington, D.C.; IEEE), a flat picture-reproducing device is described which has a multilayer control ("switching") stack. The control stack is located between a cathode and a screen and serves to control the electron flow. It consists of control plates ("subassemblies") which are formed by two layers of intersecting metal conductors between which a metallic matrix-hole plate is located. At the points of intersection of the conductors, there are elliptic holes in the conductors which are flush with the holes in the matrix-hole plate. The two metal conductor layers and the plate are frit-bonded together with the matrix-hole plate in the middle, and held in a given spaced relationship. Several such control plates are assembled to form the switching stack.

SUMMARY OF THE INVENTION

In order to achieve a uniform control of the electron flow, electron-scattering in the holes must be avoided. In addition, any charging of the isolating parts of the control plate must not produce a disturbing effect on the electron flow. It is therefore a primary object of the invention to provide a control plate which does not produce any disturbing influence on the electron flow.

This object is achieved by forming a control plate of parallel layers of metal conductors. The conductors of adjacent layers are arranged orthogonally and have superimposed openings arranged in a regular pattern. The layers of metal conductors are frit-bonded in spaced relationship.

The openings are formed so that they narrow from both surfaces of the conductors with the smallest cross section being located at a depth from one surface equal to 0–30 percent of the conductor thickness. Thus, the openings on one side of the conductor are larger than the openings on the other side of the conductor. The layers of conductors are assembled so that the larger openings of each pair of conductor layers face each other.

The conductor layers are insulated and spaced from each other through the use of an insulating glass frit. To assure adequate separation, solid insulating particles may be used in the frit. As an alternative, metal spacers may be attached to the conductor layers with said spacers being separated by insulating frit.

Because of the special cross sectional shape of the openings, electron scattering is largely avoided and focusing is achieved, whereby the transparency of the control plate to the electrons is increased. It is advantageous if the openings are formed by juxtaposed recesses in the sides of adjacent conductors because the glass frit between the conductors is then farther away from the openings and any charging of the frit will have little or no effect.

DESCRIPTION OF THE DRAWINGS

The invention will be better understood after reading the following Detailed Description of the Invention with reference to the accompanying drawings, in which:

FIG. 4 is a top view of another embodiment of the control plate, and

FIG. 5 is a section taken along line V—V of FIG. 3.

DETAILED DESCRIPTION OF THE INVENTION

Figure 1:
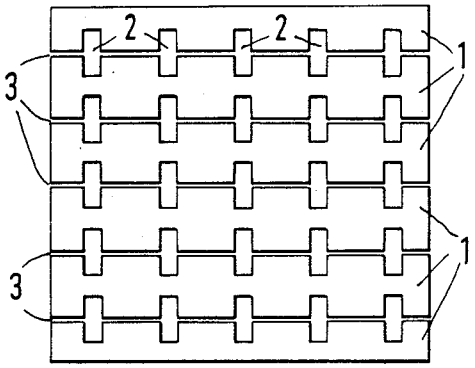
FIG. 1 is a top view of the conductors of the first layer.

The control plates shown in the drawings are intended for use in a flat picture-reproducing device and serve to control the electron flow between the cathode and the screen.

FIG. 1 shows a first layer of parallel conductors 1. Openings 2 spaced at regular intervals are formed by pairs of juxtaposed recesses formed in sides of adjacent conductors 1. An isolating interstice 3 between the conductors 1 runs through the center of the openings 2. The openings 2 are rectangular in shape with their long sides transverse to the isolating interstices 3.

Figure 2:
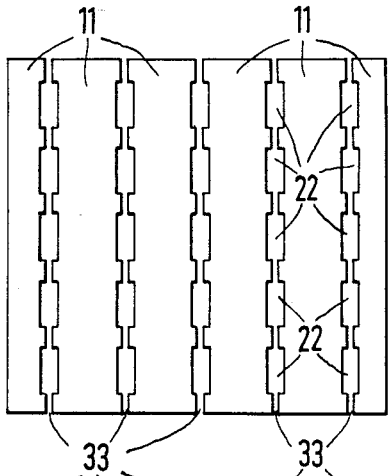
FIG. 2 is a top view of the conductors of the second layer.

FIG. 2 shows a second layer of parallel conductors 11. Here, too, openings 22 are spaced at regular intervals and are formed by pairs of juxtaposed recesses formed in sides of adjacent conductors 11. An isolating interstice 33 runs through the center of the openings 22. The openings 22 are also rectangular in shape with their short sides transverse to the isolating interstices 33. Openings 22 have the same dimensions as the openings 2.

Figure 3:
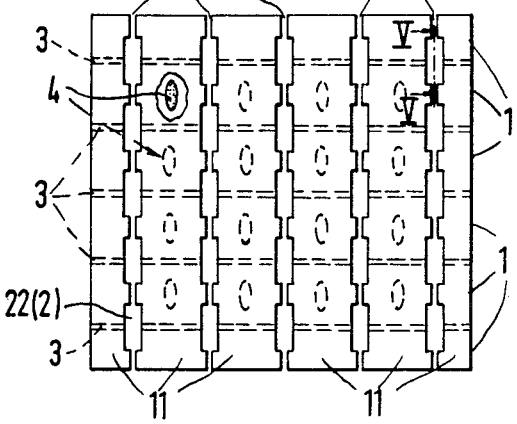
FIG. 3 is a top view of a control plate.

The completely assembled control plate shown in FIG. 3 consists of the first layer of conductors 1, the second layer of conductors 11 turned through an angle of 90° in relation to the first layer so that conductors 11 are orthogonal to conductors 1, and heaps of glass frit 4 placed in between. The glass frit 4 keeps the two layers in a given spaced relationship and joins them together. The edges of the layers can also be sealed with glass frit (not shown).

The heaps of glass frit 4 are located at each point of intersection of imaginary lines drawn through the centers of conductors 1 and conductors 11. The glass frit is thus at the greatest possible distance from the openings 2 and 22. The influence of any charging of the glass frit is therefore minimized.

Another embodiment of a completely assembled control plate is shown in FIG. 4 and consists of a first layer of conductors 1' and the second layer of the conductors 11, turned through an angle of 90° in relation to the first layer, and heaps of glass frit 4 placed in between. In the case of the conductors 1', the openings 2' are formed at the center of the conductors 1', so that the isolating interstices 3' do not run through them. The tradeoff is that the heaps of glass frit 4 are closer to the openings 2' and 22; however, a simpler drive circuit can be used in this embodiment.

The conductor layers may be manufactured using standard etching techniques. Openings 2 are etched through a first metal plate, and grooves are partially etched where the isolating interstices 3 are to be formed. The openings 22 are etched through a second metal plate, and grooves are partially etched where the isolating interstices 33 are to be formed. The glass frit 4 is deposited in the areas intended for the heaps on the first metal plate by any one of several available techniques such as screen printing. The second metal plate is then turned through 90°, placed on the first metal plate on which the glass frit has been deposited, and the two plates are frit-bonded together. The isolating interstices 3 and 33 are then etched through.

It should be pointed out that several layers of metal conductors can be assembled to form a control plate.

FIG. 5 represents a section of the control plate taken along line V—V in FIG. 3 and is provided to clearly show the unique design of the openings 2 and 22 and the heaps of the glass frit 4. Each opening 2, 22 narrows from both surfaces of the respective conductor 1, 11 to a resulting narrowest cross-sectional line 5, 55. The walls of the converging openings 2, 22 can be flat or curved. By using etching techniques the depth of line 5, 55 may be determined by controlling the period of time that each side of the conductor is subjected to etching. The openings are formed so that line 5, 55 is at a depth from one surface of approximately 0 to 30 percent of the thickness D of the conductors. Preferably line 5, 55 is at a depth from one surface of 25 percent of the conductor thickness D. The width W1 of the opening 2, 22 on the surface of the conductor 1, 11 further away from the line 5, 55 is somewhat larger than the width W2 of the opening on the other surface of the conductor. The two layers of intersecting conductors 1 and 11 are placed above each other in such a manner that the larger widths W1 of the openings 2, 22 face each other. The cross section of the space formed by the openings approximates an oval shape which largely prevents electronscattering and focuses the electron flow.

The conductors 1 and 11 are held in a given spaced relationship A by heaps of glass frit 4. In order to obtain a sufficient distance A between the conductors 1 and 11 to avoid large capacitances, insulating bodies, such as glass balls 6, are added to the glass frit 4. The bodies, or glass balls 6, must have the same coefficient of expansion as the glass frit 4 and a diameter of about 50 to 100 μm.

The distance A can also be achieved by depositing metal 7, such as aluminum or chromium, on the conductors in the areas intended for the heaps of glass frit 4 as shown on the right-hand side of FIG. 5. The metal plates are then bonded together with the help of glass frit 4. A bonding agent of copper or nickel can be present between the metal 7 and the conductors 1, 11 to improve the bond.

What is claimed is:

1. A control plate for a flat picture-reproducing device, comprising:

a plurality of conductor layers, each layer being formed of spaced metal conductors having first and second surfaces coplanar with surfaces of the layer;

openings arranged in a regular pattern in said conductor layers, said openings having a width that narrows with depth from the surfaces of the conductors, said conductor layers being arranged so that the metal conductors of adjacent layers are orthogonal to each other and the openings are superimposed; and glass frit disposed between said layers for bonding said layers to each other and providing a predetermined spacing between said layers.

2. A control plate as claimed in claim 1, wherein the smallest cross sectional width of each opening is at a depth from one surface equal to 0–30 percent of the conductor thickness, and the width of the openings on the surface of the conductors closest to the smallest cross sectional width is smaller than the width of the openings on the other surface of the conductors.

3. A control plate as claimed in claim 2, wherein the smallest cross sectional width is at a depth equal to approximately 25 percent of the conductor thickness.

4. A control plate as claimed in claim 2, wherein the conductor layers are arranged in pairs in such a manner that for each pair the surfaces having the openings with the larger widths face each other.

5. A control plate as claimed in claim 2, wherein the conductor layers are arranged in pairs in such a manner that for each pair the surfaces having the openings with the larger widths face each other.

6. A control plate as claimed in claim 1, wherein the openings in at least one conductor layer are formed by pairs of juxtaposed recesses formed in sides of adjacent conductors, and that the glass frit is present at points where center lines of the orthogonal conductors overlie each other.

7. A control plate as claimed in claim 6, wherein the openings are rectangular.

8. A control plate as claimed in claim 6, wherein the glass frit contains solid insulating particles.

9. A control plate as claimed in claim 8, wherein the particles are glass balls.

10. A control plate as claimed in claim 6, wherein the conductors have metal spacers formed on their surfaces where they overlie each other and the glass frit is disposed between said spacers.

11. A control plate as claimed in claim 10, wherein the spacers are formed of aluminum or chromium and a bonding agent of copper or nickel is present between the spacers and the conductors.

* * * * *